US009694594B2

(12) United States Patent
Ando

(10) Patent No.: US 9,694,594 B2
(45) Date of Patent: Jul. 4, 2017

(54) PRINTING APPARATUS AND INK HEATING METHOD FOR PRINTING APPARATUS

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/052,015

(22) Filed: Feb. 24, 2016

(65) Prior Publication Data

US 2016/0279964 A1 Sep. 29, 2016

(30) Foreign Application Priority Data

Mar. 26, 2015 (JP) ..... 2015-063919

(51) Int. Cl.
*B41J 2/175* (2006.01)
*B41J 2/18* (2006.01)

(52) U.S. Cl.
CPC ..... *B41J 2/18* (2013.01); *B41J 2/175* (2013.01)

(58) Field of Classification Search
USPC ..... 347/85, 6, 10, 86
See application file for complete search history.

(56) References Cited

U.S. PATENT DOCUMENTS 4,460,904 A * 7/1984 Oszczakiewicz ..... B41J 2/175 347/89
2010/0259587 A1 10/2010 Uptergrove
2010/0283808 A1* 11/2010 Terakado ..... B41J 2/175 347/6
2011/0242156 A1 10/2011 Shimoda
2013/0286120 A1* 10/2013 Kobayashi ..... B41J 11/002 347/102

FOREIGN PATENT DOCUMENTS

EP 2468512 A1 6/2012
JP 2013-240980 A 12/2013
JP 2014-180829 A 9/2014

OTHER PUBLICATIONS

The Extended European Search Report for the corresponding European Application No. 16160814.6 dated Aug. 18, 2016.

* cited by examiner

*Primary Examiner* — Matthew Luu
*Assistant Examiner* — Lily Kemathe
(74) *Attorney, Agent, or Firm* — Global IP Counselors, LLP

(57) ABSTRACT

A printing apparatus includes a first circulation flow path which includes an outgoing path and a return path, a heating section which heats the ink, a branching section which branches the outgoing path, a branch path in which the ink flows to the ink reservoir section from the branching section, and a control section capable of switching between a first state in which the ink which is heated by the heating section is returned to the ink reservoir section through the first circulation flow path and a second state in which the ink is returned to the ink reservoir section through the branch path, in which in at least a portion of a period from a start-up of the printing apparatus until image formation is carried out, a mode is set to the second state and during the image formation, the mode is set to the first state.

10 Claims, 6 Drawing Sheets

PRINTING APPARATUS AND INK HEATING METHOD FOR PRINTING APPARATUS

BACKGROUND

1. Technical Field

The present invention relates to a printing apparatus which is provided with a heating section which heats an ink and an ink heating method for the printing apparatus.

2. Related Art

In the related art, an ink jet recording apparatus is known which is provided with a head which ejects a UV ink, a sub-tank which reserves the UV ink, an ink circulation flow path including a circulation outgoing path in which the UV ink which is supplied from the sub-tank to the head flows, and a circulation return path in which the ink which returns to the sub-tank from the head flows, a heating mechanism which is provided in the circulation outgoing path and heats the UV ink which flows in the circulation outgoing path, and a filter which is provided between the sub-tank and the heating mechanism in the circulation outgoing path and filters the UV ink which flows in the circulation outgoing path. In the ink jet recording apparatus, by heating the UV ink to a predetermined temperature using the heating mechanism while causing the UV ink to circulate in an ink circulation path, the UV ink is caused to have an appropriate viscosity for ejection from the head (refer to JP-A-2013-240980).

The present inventor discovered the following problems.

In a printing apparatus such as the ink jet recording apparatus of the related art, there is a case in which a filter section is provided in an ink circulation flow path. In this case, since the pressure loss of the ink in the ink circulation flow path is great, in response to this, the flow rate of the ink in the heating section at the time of ink circulation in the ink circulation flow path is reduced. As a result, the heating efficiency of the ink is low, and a long time is necessary to heat the ink to a predetermined temperature.

In a printing apparatus such as the ink jet recording apparatus of the related art, the flow path length of a first circulation flow path from the heating mechanism to the sub-tank is comparatively long. Therefore, the heat discharge which is radiated from the ink which is heated by the heating mechanism by the time the ink circulates within the first circulation flow path and reaches the heating mechanism again is comparatively great. As a result, the heating efficiency of the ink is low, and a long time is necessary to heat the ink to a predetermined temperature.

SUMMARY

An advantage of some aspects of the invention is to provide a printing apparatus capable of heating an ink to a predetermined temperature in a short time, and an ink heating method for the printing apparatus.

According to an aspect of the invention, there is provided a printing apparatus including an ink ejecting head which ejects an ink and an ink reservoir section which reserves the ink. The printing apparatus includes a first circulation flow path which includes a circulation outgoing path in which the ink which is supplied to the ink ejecting head from the ink reservoir section flows and a circulation return path in which the ink which returns to the ink reservoir section from the ink ejecting head flows, a heating section which is provided in the circulation outgoing path and heats the ink which flows in the circulation outgoing path, a branching section which branches the circulation outgoing path between the heating section and the ink ejecting head, a branch path in which the ink which returns to the ink reservoir section from the branching section flows, and a control section capable of switching between a first state in which the ink which is heated in the heating section is returned to the ink reservoir section through the first circulation flow path and a second state in which the ink is returned to the ink reservoir section through the branch path, in which the control section sets a mode to the second state in at least a portion of a period from a start-up of the printing apparatus until the ink is ejected from the ink ejecting head to carry out image formation and sets the mode to the first state during the image formation.

In the printing apparatus, returning the ink which is heated by the heating section to the ink reservoir section through the branch path preferably results in higher heating efficiency of the ink than returning the ink to the ink reservoir section through the first circulation flow path.

In this case, a branch path through which it is possible to return the heated ink to the ink reservoir section is included separately from the first circulation flow path, and returning the ink to the ink reservoir section through the branch path results in higher heating efficiency of the ink than returning the ink through the first circulation flow path. Therefore, the printing apparatus is capable of heating the ink to a predetermined temperature in a short time.

The printing apparatus preferably further includes a valve capable of entering a first state in which the ink is prevented from flowing from an upstream side outgoing path which is closer to the upstream side than the branching section in the circulation outgoing path to the branch path, and a second state in which the ink is allowed to flow from the upstream side outgoing path to the branch path.

The branching section preferably includes a valve capable of entering a first state in which the ink is prevented from flowing from an upstream side outgoing path which is closer to the upstream side than the branching section in the circulation outgoing path to the branch path, and a second state in which the ink is allowed to flow from the upstream side outgoing path to the branch path.

In this case, when the valve enters the first state, the ink circulates within the first circulation flow path and the ink is supplied to the ink ejecting head. Accordingly, the printing apparatus enters a state in which it is possible to eject the ink from the ink ejecting head. When the valve enters the second state, the ink circulates within the second circulation flow path. Accordingly, the printing apparatus enters a state in which it is possible to heat the ink in a short time. Therefore, in this case, by switching a state of the valve between the first state and the second state, it is possible to switch a state of the printing apparatus between a state of in which it is possible to eject the ink from the ink ejecting head and a state in which it is possible to heat the ink in a short time.

The printing apparatus preferably further includes a control section which switches a state of the valve to the second state during the start-up of the printing apparatus.

In this case, a state of the valve automatically switches to the second state during the start-up of the printing apparatus.

Therefore, in this case, during the start-up of the printing apparatus, it is possible to cause the ink to circulate within the second circulation flow path without the user performing an operation of switching a state of the valve to the second state.

The printing apparatus preferably further includes a filter section which is provided in at least one of the ink ejecting head and an area between the branching section and the ink ejecting head in the circulation outgoing path and filters the ink which flows in the first circulation flow path.

In this case, the filter section is not provided in the second circulation flow path which includes the upstream side outgoing path which is closer to the upstream side than the branching section in the circulation outgoing path and the branch path. Therefore, the pressure loss of the ink in the second circulation flow path is less than the pressure loss of the ink in the first circulation flow path which is provided with the filter section. Accordingly, the flow rate of the ink in the heating section when the ink circulates in the second circulation flow path is higher than the flow rate of the ink in the heating section when the ink circulates in the first circulation flow path. Therefore, when the ink is heated using the heating section while causing the ink to circulate within the second circulation flow path, the heating efficiency of the ink is improved in comparison to a case in which the ink is heated using the heating section while causing the ink to circulate within the first circulation flow path. Therefore, the printing apparatus is capable of heating the ink to a predetermined temperature in a short time. Note that, an expression that the filter section is provided between the branching section and the ink ejecting head in the circulation outgoing path also means that the filter section is provided inside the branching section.

In the printing apparatus, a first filter section is preferably provided between the branching section and the ink ejecting head in the circulation outgoing path as the filter section, and an upstream end of the branch path is preferably provided above the first filter section.

In this case, the bubbles trapped in the first filter section enter the branch path due to the buoyancy of the bubbles and are discharged to the ink reservoir section when the ink circulates within the second circulation flow path. Therefore, by causing the ink to circulate within the second circulation flow path before causing the ink to circulate within the first circulation flow path, it is possible to cause the ink to circulate within the first circulation flow path in a state in which there are as few bubbles as possible in the first filter section. Therefore, in this case, the pumping of bubbles to the ink ejecting head side is suppressed. Note that, an expression that the first filter section is provided between the branching section and the ink ejecting head in the circulation outgoing path also means that the first filter section is provided inside the branching section.

In the printing apparatus, a flow path length obtained by adding a flow path length of an upstream side outgoing path which is closer to an upstream side than the branching section in the circulation outgoing path to a flow path length of the branch path is preferably shorter than a flow path length of the first circulation flow path.

In this case, the heat discharge while the ink circulates within the second circulation flow path, which includes the flow path length of the upstream side outgoing path which is closer to the upstream side than the branching section in the circulation outgoing path and the flow path length of the branch path, is less than the heat discharge while the ink circulates within the first circulation flow path. Therefore, in this case, the heating efficiency of the ink is further improved.

According to another aspect of the invention, there is provided a printing apparatus including an ink ejecting head which ejects an ink and an ink reservoir section which reserves the ink. The printing apparatus includes a first circulation flow path which includes a circulation outgoing path in which the ink which is supplied to the ink ejecting head from the ink reservoir section flows and a circulation return path in which the ink which returns to the ink reservoir section from the ink ejecting head flows, a heating section which is provided in the circulation outgoing path and heats the ink which flows in the circulation outgoing path, a branching section which branches the circulation outgoing path between the heating section and the ink ejecting head, a branch path in which the ink which returns to the ink reservoir section from the branching section flows, an operation section which receives an operation of switching between a first state in which the ink which is heated in the heating section is returned to the ink reservoir section through the first circulation flow path and a second state in which the ink is returned to the ink reservoir section through the branch path, and a control section which switches between the first state and the second state when the operation section receives the switching operation.

In this case, the first state and the second state are switched when the operation section receives a switching operation. Therefore, in this case, it is possible to change the circulation path of the ink, as necessary.

According to still another aspect of the invention, there is provided an ink heating method for a printing apparatus. The printing apparatus includes an ink ejecting head which ejects an ink, an ink reservoir section which reserves the ink, a first circulation flow path which includes a circulation outgoing path in which the ink which is supplied to the ink ejecting head from the ink reservoir section flows and a circulation return path in which the ink which returns to the ink reservoir section from the ink ejecting head flows, a heating section which is provided in the circulation outgoing path and heats the ink which flows in the circulation outgoing path, a branching section which branches the circulation outgoing path between the heating section and the ink ejecting head, and a branch path in which the ink which returns to the ink reservoir section from the branching section flows, in which returning the ink which is heated by the heating section to the ink reservoir section through the branch path results in higher heating efficiency of the ink than returning the ink to the ink reservoir section through the first circulation flow path. The method includes heating the ink using the heating section while causing the ink to circulate within a second circulation flow path which includes an upstream side outgoing path which is closer to an upstream side than the branching section in the circulation outgoing path and the branch path.

In this case, a branch path through which it is possible to return the heated ink to the ink reservoir section is included separately from the first circulation flow path, returning the ink to the ink reservoir section through the branch path results in higher heating efficiency of the ink than returning the ink through the first circulation flow path, and the ink is heated while causing the ink to circulate within the second circulation flow path which includes the upstream side outgoing path which is closer to the upstream side than the branching section in the circulation outgoing path and the branch path. Therefore, the ink heating method for the printing apparatus is capable of heating the ink to a predetermined temperature in a short time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of a printing apparatus 1 according to the embodiment of the invention with reference to the accompanying drawings.

Figure 1:
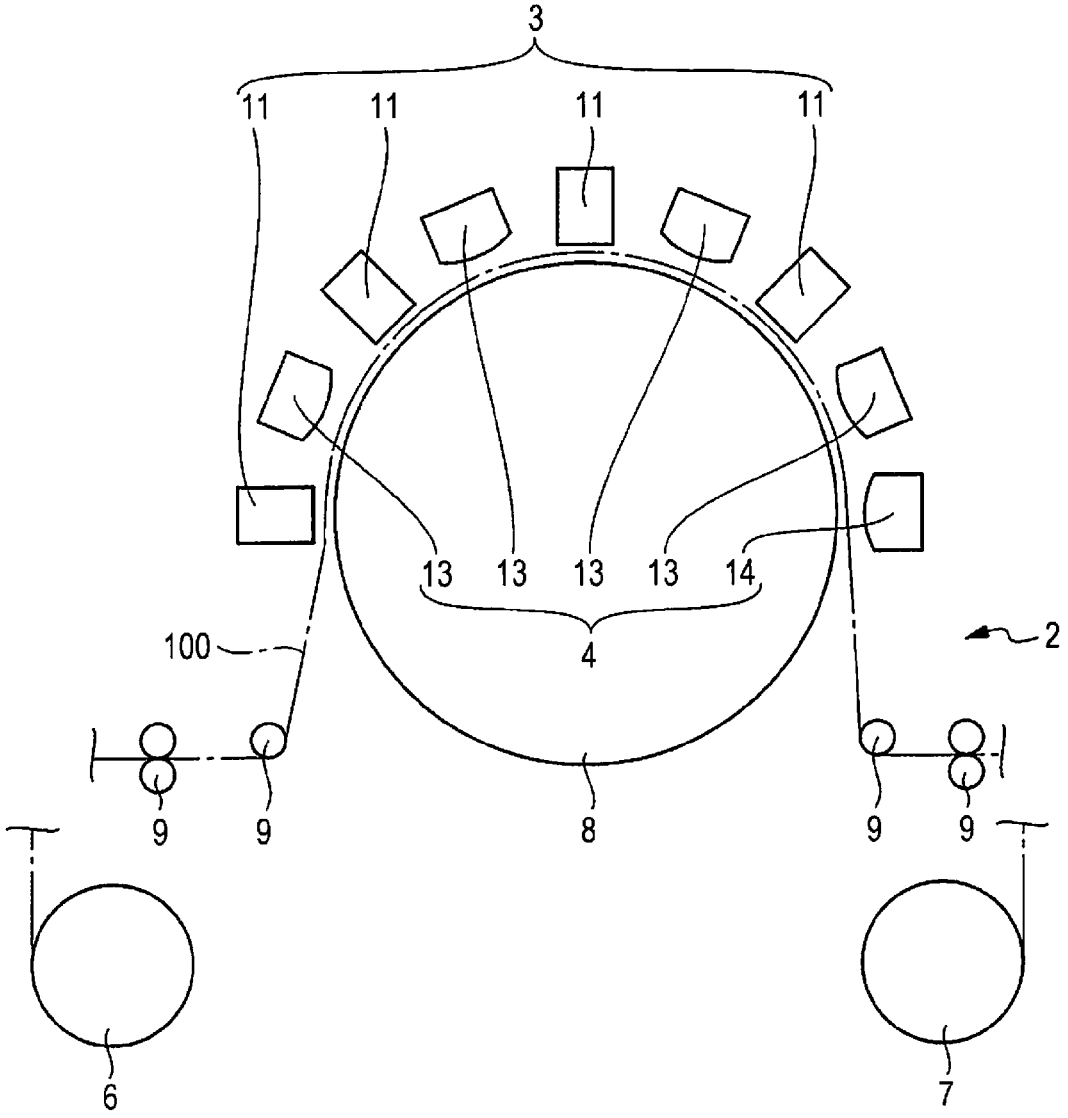
FIG. 1 is a schematic configuration diagram of a printing apparatus according to an embodiment of the invention.

Description will be given of the overall configuration of the printing apparatus 1 with reference to FIG. 1. The printing apparatus 1 performs printing on a printing medium 100 which is set therein by ejecting an ultraviolet curing ink (hereinafter referred to as a "UV ink"). The printing medium 100 is a belt-shaped continuous paper sheet. Note that, the material of the printing medium 100 is not particularly limited, and various materials such as paper-based materials and film-based materials may be used.

The printing apparatus 1 is provided with a feed section 2, an ink ejecting section 3, and an irradiating section 4. Although omitted from the drawing in FIG. 1, the printing apparatus 1 is provided with an ink supply section 5 (refer to FIG. 2) which supplies a UV ink to the ink ejecting section 3.

The feed section 2 is a roll-to-roll system and feeds the printing medium 100. The feed section 2 is provided with a feed-out reel 6, a winding reel 7, a rotating drum 8, and a plurality of rollers 9.

The printing medium 100 which is fed out from the feed-out reel 6 passes the rotating drum 8 and the plurality of rollers 9 and is wound onto the winding reel 7. The rotating drum 8 is a cylindrical drum which is supported by a supporting mechanism (not shown) to be capable of rotating. When the printing medium 100 is fed along the circumferential surface of the rotating drum 8, the rotating drum 8 is passively rotated due to the friction force between the circumferential surface and the printing medium 100. The rotating drum 8 functions as a platen in relation to the ink ejecting section 3.

The ink ejecting section 3 is provided with a plurality of head units 11. The plurality of head units 11 is provided to line up along the circumferential surface of the rotating drum 8. The plurality of head units 11 correspond, one-for-one, with a plurality of types of UV ink (for example, the four colors CYMK). Each of the head units 11 is provided with a plurality of ink ejecting heads 12 (refer to FIG. 2) which eject UV ink using an ink jet system. The head units 11 eject the UV inks onto the printing medium 100 which is supported on the circumferential surface of the rotating drum 8. Accordingly, a color image is formed on the printing medium 100.

The irradiating section 4 is provided with a plurality of temporary curing irradiators 13 and a real curing irradiator 14. The plurality of temporary curing irradiators 13 is provided to line up along the circumferential surface of the rotating drum 8 alternately, one for each of the plurality of head units 11. The temporary curing irradiators 13 are provided on the downstream side of the feed path of the printing medium 100 in relation to the corresponding head units 11. The temporary curing irradiators 13 irradiate the printing medium 100 onto which the UV ink is ejected with ultraviolet rays. Accordingly, the UV ink is temporarily cured straight after landing on the printing medium 100, and spreading of the dots and mixing of the colors are suppressed. The real curing irradiator 14 is provided closer to the downstream side than the temporary curing irradiator 13 which is provided closest to the downstream side in the feed path. The real curing irradiator 14 irradiates the printing medium 100 which is subjected to the ejection of the UV inks and the temporary curing with ultraviolet rays of a greater integral light quantity than the temporary curing irradiators 13. Accordingly, the UV ink which lands on the printing medium 100 is completely cured and is fixed to the printing medium 100.

Note that, it is possible to use, for example, a light emitting diode (LED) lamp, a high pressure mercury lamp, or the like which radiates ultraviolet rays in the temporary curing irradiators 13 and the real curing irradiator 14.

Figure 2:
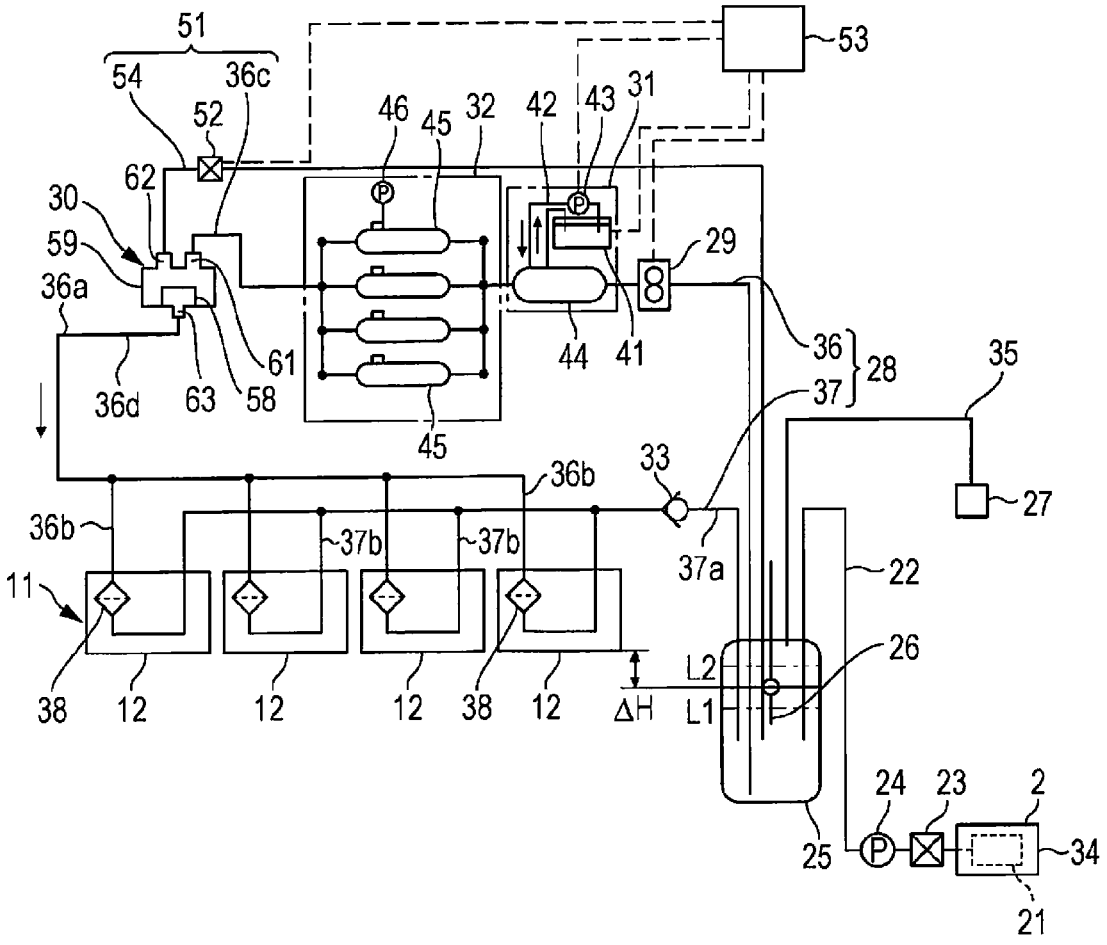
FIG. 2 is a piping flow diagram illustrating an ink supply section which is provided in the printing apparatus illustrated in FIG. 1.

Description will be given of the ink supply section 5 with reference to FIG. 2. The ink supply section 5 is provided with an ink cartridge 21, a supply flow path 22, a supply open-close valve 23, a supply pump 24, a sub-tank 25, a liquid level sensor 26, a compressing-decompressing section 27, a first circulation flow path 28, a heating section 31, an degassing section 32, an outgoing path filter 30, a check valve 33, a second circulation flow path 51, a second circulation flow path open-close valve 52, and a control section 53.

The UV ink is stored in the ink cartridge 21. The ink cartridge 21 is mounted in a holder 34. The upstream end of the supply flow path 22 is inserted into the ink cartridge 21 which is mounted in the holder 34, and the downstream end of the supply flow path 22 is inserted into the sub-tank 25. In order from the upstream side, the supply open-close valve 23 and the supply pump 24 are provided in the supply flow path 22. The supply open-close valve 23 opens and closes the supply flow path 22. It is possible to use a magnetic operation valve, for example, as the supply open-close valve 23. The supply pump 24 supplies the UV ink which is stored in the ink cartridge 21 to the sub-tank 25 via the supply flow path 22.

The sub-tank 25 temporarily reserves the UV ink which is pumped from the ink cartridge 21. The sub-tank 25 is an open system tank. The liquid level sensor 26 detects whether or not the liquid level of the UV ink in the sub-tank 25 is greater than or equal to a first liquid level L1, and detects whether or not greater than or equal to a second liquid level L2 which is greater than the first liquid level L1. When the liquid level sensor 26 detects that the liquid level of the UV ink in the sub-tank 25 is less than the first liquid level L1, the UV ink is supplied from the ink cartridge 21 to the sub-tank 25. When the liquid level sensor 26 detects that the liquid level of the UV ink in the sub-tank 25 is greater than or equal to the second liquid level L2, the supply of the UV ink from the ink cartridge 21 to the sub-tank 25 is stopped. Accordingly, the liquid level of the sub-tank 25 is maintained between the first liquid level L1 and the second liquid level L2. Therefore, a differential head ΔH between the nozzle surface of the ink ejecting head 12 and the liquid surface of the sub-tank 25 is maintained within a predetermined range. Accordingly, the back pressure of the UV ink inside the ink ejecting head 12 is maintained within a predetermined range (for example, −400 Pa to 3000 Pa), and a good meniscus is formed in the nozzles of the ink ejecting head 12.

The compressing-decompressing section 27 compresses or decompresses the inside of the sub-tank 25 by supplying air into the sub-tank 25 or discharging the air in the sub-tank 25 via an air flow path 35. For example, the compressing-decompressing section 27 compresses the sub-tank 25 during the initial filling of the first circulation flow path 28 with the UV ink, during the cleaning of the ink ejecting heads 12, or the like.

The first circulation flow path 28 is the flow path of the UV ink which passes from the sub-tank 25, through the ink ejecting heads 12, and returns to the sub-tank 25. The first circulation flow path 28 is provided with a circulation outgoing path 36 and a circulation return path 37.

The UV ink which is supplied to the ink ejecting heads 12 from the sub-tank 25 flows in the circulation outgoing path 36. The circulation outgoing path 36 is provided with an outgoing path side root path 36*a* and a plurality of outgoing path side first branch paths 36*b* which branch from the outgoing path side root path 36*a*. The upstream end of the outgoing path side root path 36*a* is inserted into the sub-tank 25. In order from the upstream side, the outgoing path side root path 36*a* is provided with a circulation pump 29, the heating section 31, the degassing section 32, and the outgoing path filter 30. Note that, the outgoing path side root path 36*a* which is closer to the upstream side than the outgoing path filter 30 is referred to as an upstream side root path 36*c*, and the outgoing path side root path 36*a* which is closer to the downstream side than the outgoing path filter 30 is referred to as a downstream side root path 36*d*. One of the outgoing path side first branch paths 36*b* is provided for one of the ink ejecting heads 12. The downstream end of the outgoing path side first branch path 36*b* is connected to the ink ejecting head 12.

The UV ink which returns to the sub-tank 25 from the ink ejecting head 12 flows in the circulation return path 37. In other words, of the UV ink which is supplied from the sub-tank 25 to the ink ejecting head 12 via the circulation outgoing path 36, the UV ink which is not ejected from the ink ejecting heads 12 returns to the sub-tank 25 via the circulation return path 37. The circulation return path 37 is provided with a plurality of return path side branch paths 37*b*, and a return path side root path 37*a* at which the plurality of return path side branch paths 37*b* meet n the downstream side thereof. One of the return path side branch paths 37*b* is provided for one of the ink ejecting heads 12. The upstream end of the return path side branch path 37*b* is connected to the ink ejecting head 12. The downstream end of the return path side root path 37*a* is inserted into the sub-tank 25. The check valve 33 is provided in the return path side root path 37*a*.

The circulation pump 29 pumps the UV ink which is reserved in the sub-tank 25 toward the ink ejecting head 12 side. Note that, it is possible to favorably use a gear pump as the circulation pump 29 because it is possible to suppress pulsation and there is little fluctuation in the flow rate with the passage of time.

The heating section 31 heats the UV ink which flows in the first circulation flow path 28 to a predetermined temperature (for example 35° C. to 40° C.). The predetermined temperature is a temperature at which the UV ink which is supplied to the ink ejecting heads 12 reaches a viscosity which is appropriate for ejection from the ink ejecting heads 12. During the start-up of the printing apparatus 1, the printing apparatus 1 starts the printing operation after heating the UV ink which has a lower temperature than the predetermined temperature to the predetermined temperature using the heating section 31.

The heating section 31 is provided with a hot water tank 41 including a heater and a thermometer, a hot water circulation flow path 42, a hot water pump 43, and a heat exchanger 44. The hot water tank 41 reserves hot water which is adjusted to fall within a predetermined temperature range. The hot water circulation flow path 42 is a flow path running from the hot water tank 41, through the heat exchanger 44, and returns to the hot water tank 41. The hot water pump 43 causes the hot water to circulate within the hot water circulation flow path 42. The heat exchanger 44 performs heat exchanging between the hot water which flows in the hot water circulation flow path 42 and the UV ink which flows in the first circulation flow path 28.

The degassing section 32 degasses the UV ink which flows in the first circulation flow path 28. Accordingly, the supplying of the UV ink containing bubbles to the ink ejecting heads 12 is prevented. The degassing section 32 is provided with a degassing module 45 and a negative pressure pump 46. The degassing module 45 is provided with a plurality of hollow fiber membranes, for example. The negative pressure pump 46 reduces the pressure outside of the hollow fiber membranes. Accordingly, the UV ink which flows in the hollow fiber membranes is degassed.

The outgoing path filter 30 removes foreign matter in the UV ink by filtering the UV ink which flows in the circulation outgoing path 36. Examples of the foreign matter include dust and bubbles which are mixed in when the upstream end of the supply flow path 22 is inserted into the ink cartridge 21, a polymer of the UV ink caused by friction heat which is generated by the circulation pump 29 which is a gear pump, a polymer of the UV ink which reacts with the hot water in the heat exchanger 44, and fibers which are generated from the hollow fiber membrane of the degassing module 45. Note that, although head filters 38 which filter the UV ink are also provided on the inlet side of the ink ejecting heads 12, it is possible to cause the head filters 38 which are difficult to exchange to last a long time by providing the outgoing path filter 30 in the circulation outgoing path 36.

The outgoing path filter 30 is provided with a filter element 58 and a filter housing 59. The filter element 58 filters the UV ink. The filter element 58 is housed in the filter housing 59. The filter housing 59 is provided with a first junction section 61 and a second junction section 62 which are provided closer to the upstream side than the filter element 58, and a third junction section 63 which is provided closer to the downstream side than the filter element 58. The downstream end of the upstream side root path 36*c* is connected to the first junction section 61. The upstream end of an outgoing path side second branch path 54 is connected to the second junction section 62. The upstream end of the downstream side root path 36*d* is connected to the third junction section 63. The first junction section 61 and the second junction section 62 are provided above the filter element 58, and the third junction section 63 is provided below the filter element 58. The filter housing 59 causes the circulation outgoing path 36 to branch into the outgoing path side second branch path 54 which is connected to the second junction section 62 and the downstream side root path 36*d* which is connected to the third junction section 63 between the heating section 31 and the filter element 58.

The check valve 33 allows the flowing of the UV ink from the ink ejecting head 12 side to the sub-tank 25 side in the circulation return path 37, and prevents the backward flowing of the UV ink from the sub-tank 25 side to the ink ejecting head 12 side. The flowing of foreign matter contained in the UV ink which flows backward in the circulation return path 37 into the ink ejecting heads 12 is suppressed by the check valve 33. Note that, in a case in which the circulation return path 37 is removed from the sub-tank 25 in order to exchange a portion of the ink ejecting heads 12 or the like, the UV ink flows backward to the ink ejecting head 12 side in the circulation return path 37.

The second circulation flow path 51 is a flow path in which the UV ink which passes through the circulation pump 29, the heating section 31, and the degassing section 32 from the sub-tank 25 returns to the sub-tank 25 without passing through the filter element 58 and the ink ejecting heads 12. The second circulation flow path 51 is provided with the outgoing path side second branch path 54 and the upstream side root path 36*c* described above.

The outgoing path side second branch path 54 branches from the circulation outgoing path 36 in the filter housing 59, that is, between the heating section 31 and the filter element 58. As described above, the second junction section 62 of the outgoing path filter 30 is connected to the upstream end of the outgoing path side second branch path 54, and the downstream end of the outgoing path side second branch path 54 is inserted into the sub-tank 25. The second circulation flow path open-close valve 52 is provided in the outgoing path side second branch path 54.

The second circulation flow path open-close valve 52 opens and closes the outgoing path side second branch path 54. In other words, the second circulation flow path open-close valve 52 can enter a first state and a second state. In the first state, the outgoing path side second branch path 54 is blocked and the flowing of the UV ink from the upstream side root path 36*c* to the outgoing path side second branch path 54 is prevented, and in the second state, the outgoing path side second branch path 54 is opened and the flowing of the UV ink from the upstream side root path 36*c* to the outgoing path side second branch path 54 is allowed. When the circulation pump 29 operates with the second circulation flow path open-close valve 52 in the first state, the UV ink circulates within the first circulation flow path 28. Meanwhile, when the circulation pump 29 operates with the second circulation flow path open-close valve 52 in the second state, of the UV ink which is pumped from the sub-tank 25 to the outgoing path filter 30, although a portion passes through the filter element 58 and flows to the downstream side root path 36*d*, since most flows to the outgoing path side second branch path 54, the UV ink mainly circulates within the second circulation flow path 51. During an ink heating process (described later), the second circulation flow path open-close valve 52 enters the second state, and in other cases, is controlled to enter the first state. It is possible to use a magnetic operation valve, for example, as the second circulation flow path open-close valve 52.

The flow path length of the second circulation flow path 51, that is, the flow path length obtained by adding the flow path length of the upstream side root path 36*c* to the flow path length of the outgoing path side second branch path 54 is shorter than the flow path length of the first circulation flow path 28. Therefore, the heat discharge while the UV ink circulates within the second circulation flow path 51 is less than the heat discharge while the UV ink circulates within the first circulation flow path 28. The filter element 58 and the head filters 38 are not provided in the second circulation flow path 51. Therefore, the pressure loss of the UV ink in the outgoing path side second branch path 54 is less than the pressure loss of the UV ink in the first circulation flow path 28 which is provided with the filter element 58 and the head filters 38. Accordingly, the flow rate of the UV ink in the heating section 31 when the UV ink mainly circulates within the second circulation flow path 51 (when the second circulation flow path open-close valve 52 is in the second state) is higher than the flow rate of the UV ink in the heating section 31 when the UV ink circulates within the first circulation flow path 28 (when the second circulation flow path open-close valve 52 is in the first state). Therefore, when the UV ink is heated using the heating section 31 while causing the UV ink to mainly circulate within the second circulation flow path 51, the heating efficiency of the UV ink is improved in comparison to a case in which the UV ink is heated using the heating section 31 while causing the UV ink to circulate within the first circulation flow path 28.

As described above, the second junction section 62 of the outgoing path filter 30, that is, the upstream end of the outgoing path side second branch path 54 is provided above the filter element 58. Therefore, the bubbles trapped in the filter element 58 pass through the second junction section 62 due to the buoyancy of the bubbles, enter the outgoing path side second branch path 54, and are discharged to the sub-tank 25 when the UV ink circulates within the second circulation flow path 51.

The control section 53 is provided with a central process unit (CPU) which is not shown, a read only memory (ROM), a random access memory (RAM), and the like, none of which is depicted in the drawings. A program for executing the ink heating process (described later) is reserved in the ROM of the control section 53. The CPU of the control section 53 loads a program from the ROM and executes the program using the RAM, and controls the heater, the hot water pump 43, the circulation pump 29, and the second circulation flow path open-close valve 52 of the hot water tank 41.

Incidentally, during the start-up of the printing apparatus 1, when heating the UV ink to the predetermined temperature, it is possible to heat the UV ink using the heating section 31 while causing the UV ink to circulate within the first circulation flow path 28; however, in this case, as described above, since the flow rate of the UV ink in the heating section 31 is comparatively lower in comparison with a case in which the UV ink mainly circulates within the second circulation flow path 51, the heating efficiency of the UV ink is low. Therefore, a long time (for example, 15 minutes) is necessary to heat the UV ink to the predetermined temperature. In other words, the waiting time from the start-up of the printing apparatus 1 until the starting of the printing operation becomes longer. Therefore, the control section 53 executes the following ink heating process during the start-up of the printing apparatus 1.

Figure 3:
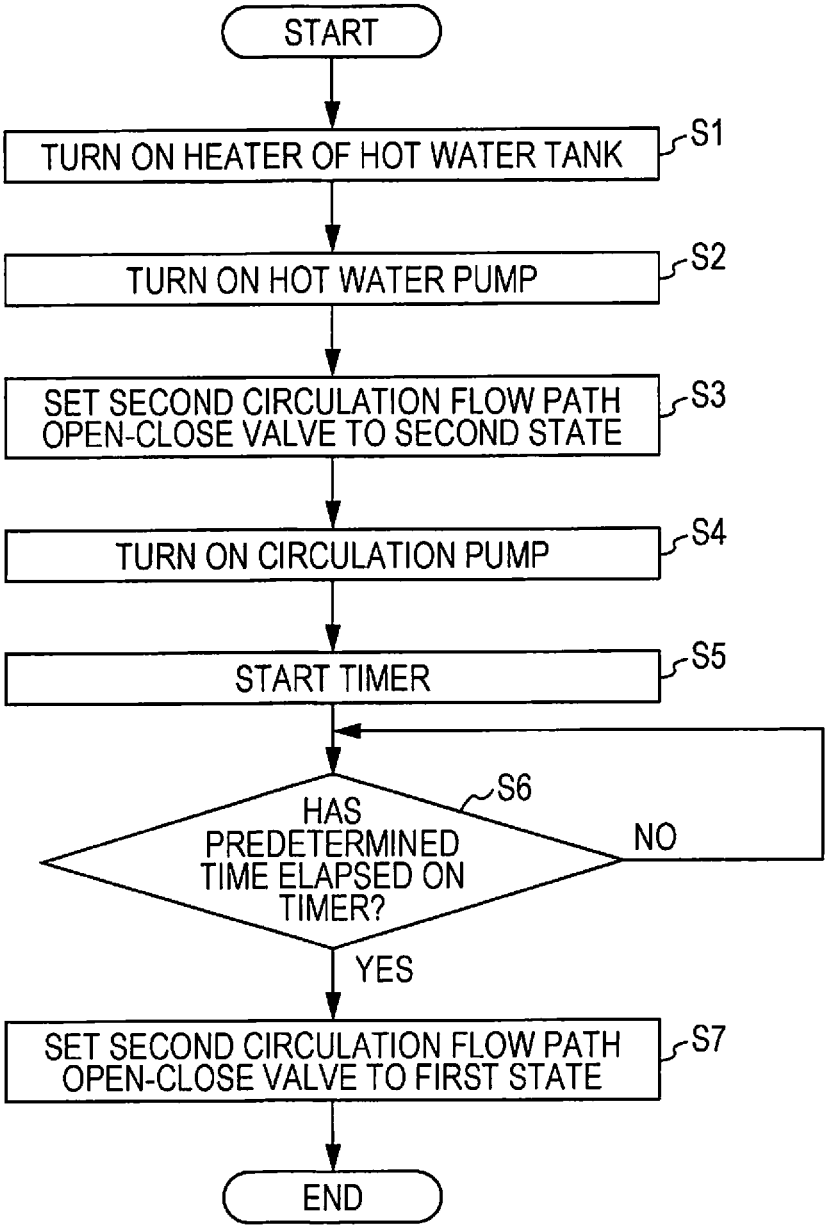
FIG. 3 is a flowchart illustrating an ink heating process which is executed in the ink supply section illustrated in FIG. 2.

Description will be given of the ink heating process which is executed by the control section 53 with reference to FIG. 3. When the ink heating process is started, the control section 53 turns on the heater of the hot water tank 41 in step S1. Note that, the control section 53 carries out feedback control on the heater of the hot water tank 41 based on a detected temperature of the hot water within the hot water tank 41. The control section 53 proceeds to step S2 and turns on the hot water pump 43. The control section 53 proceeds to step S3 and sets the second circulation flow path open-close valve 52 to the second state. In other words, the control section 53 causes the second circulation flow path open-close valve 52 to operate such that the outgoing path side second branch path 54 is opened. The control section 53 proceeds to step S4 and turns on the circulation pump 29. Accordingly, the UV ink mainly circulates within the second circulation flow path 51.

The control section 53 proceeds to step S5 and starts the timer which is embedded in the control section 53. The control section 53 proceeds to step S6 and determines whether or not a predetermined time (for example, 10 minutes) has elapsed on the timer. The predetermined time is set in advance by obtaining the time for the UV ink to be heated to the predetermined temperature using tests or the like. When the control section 53 determines that the predetermined time has not elapsed on the timer (no in S6), the control section 53 repeatedly performs step S6. When the control section 53 determines that the predetermined time has elapsed on the timer (yes in S6), the control section 53 proceeds to step S7. In step S7, the control section 53 sets the second circulation flow path open-close valve 52 to the first state. In other words, the control section 53 causes the second circulation flow path open-close valve 52 to operate such that the outgoing path side second branch path 54 is blocked. Accordingly, the UV ink circulates within the first circulation flow path 28. When the control section 53 executes step S7, the ink heating process is ended.

Due to the control section 53 executing the ink heating process, during the start-up of the printing apparatus 1, the printing apparatus 1 heats the UV ink to the predetermined temperature using the heating section 31 while causing the UV ink to circulate within the second circulation flow path 51. In this case, as described above, since the flow rate of the UV ink in the heating section 31 is comparatively high, the heating efficiency of the UV ink is improved. Therefore, the printing apparatus 1 is capable of heating the UV ink to the predetermined temperature in a short time (for example, 10 minutes).

As described above, according to the printing apparatus 1 of the present embodiment, it is possible to heat the UV ink to the predetermined temperature in a short time. In other words, the printing apparatus 1 is capable of shortening the waiting time from the start-up of the printing apparatus 1 until the starting of the printing operation.

According to the printing apparatus 1 of the present embodiment, by switching the second circulation flow path open-close valve 52 between the first state and the second state, it is possible to switch the printing apparatus 1 between a state in which it is possible to eject the UV ink from the ink ejecting heads 12 and a state in which it is possible to heat the UV ink in a short time.

According to the printing apparatus 1 of the present embodiment, the second circulation flow path open-close valve 52 automatically switches to the second state during the start-up of the printing apparatus 1. Therefore, during the start-up of the printing apparatus 1, it is possible to cause the UV ink to circulate within the second circulation flow path 51 without the user performing an operation of switching the second circulation flow path open-close valve 52 to the second state.

According to the printing apparatus 1 of the present embodiment, during the start-up of the printing apparatus 1, the ink heating process is executed before the printing operation. In other words, before the UV ink is caused to circulate within the first circulation flow path 28, the printing apparatus 1 causes the UV ink to circulate within the second circulation flow path 51. The bubbles trapped in the filter element 58 pass through the second junction section 62 due to the buoyancy of the bubbles, enter the outgoing path side second branch path 54, and are discharged to the sub-tank 25 when the UV ink circulates within the second circulation flow path 51. Therefore, it is possible to cause the UV ink to circulate within the first circulation flow path 28 in a state in which there are as few bubbles as possible in the filter element 58 in which bubbles are easily trapped. Accordingly, the pumping of bubbles to the ink ejecting head 12 side is suppressed, and cases in which ejection faults of the ink ejecting heads 12 are caused by bubbles are reduced. Therefore, the printing apparatus 1 is capable of suppressing the occurrence of missing dots in the printed image.

Note that, the sub-tank 25 is an example of "an ink reservoir section". The head filters 38 and the filter element 58 are examples of "a filter section". The filter element 58 is an example of "a first filter section". The filter housing 59 is an example of "a branching section".

The outgoing path side second branch path 54 is an example of "a branch path". The upstream side root path 36*c* is an example of "an upstream side outgoing path". The second circulation flow path open-close valve 52 is an example of "a valve".

The invention is not limited to the embodiment described above, and it goes without saying that various configurations may be adopted within a scope that does not depart from the gist of the invention. For example, the present embodiment may be modified to the forms described below.

Figure 4:
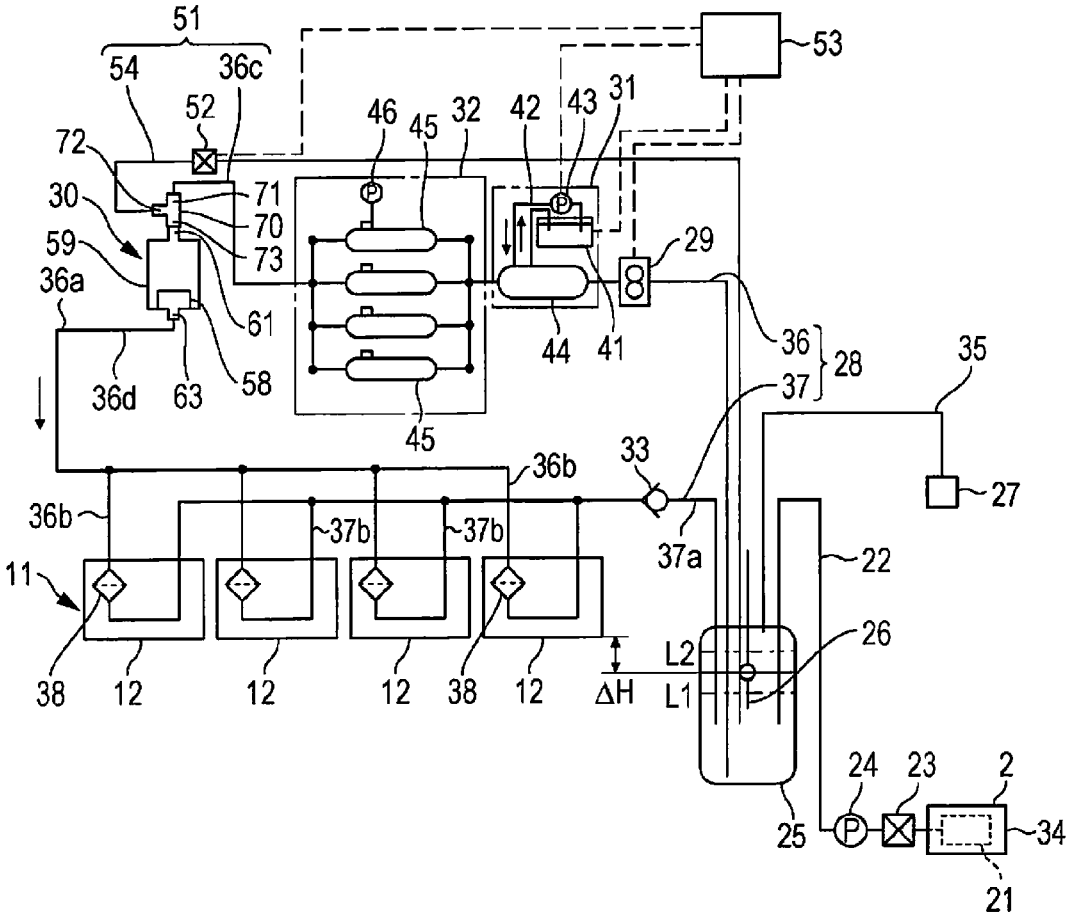
FIG. 4 is a piping flow diagram illustrating an ink supply section according to a modification example.

Description will be given of an ink supply section 5A according to a modification example with reference to FIG. 4. Although the ink supply section 5A is configured in substantially the same manner as the ink supply section 5 described above, the configuration differs in that the outgoing path side second branch path 54 branches from the outgoing path side root path 36*a* via a branching junction 70. The branching junction 70 is provided with a first connection port 71, a second connection port 72, and a third connection port 73. The second connection port 72 protrudes in a direction which is substantially perpendicular to the first connection port 71 and the third connection port 73. The third connection port 73 protrudes on the opposite side from the first connection port 71. The downstream end of the upstream side root path 36*c* is connected to the first connection port 71. The upstream end of the outgoing path side second branch path 54 is connected to the second connection port 72. The first junction section 61 of the outgoing path filter 30 is connected to the third connection port 73. Note that, the outgoing path filter 30 is not provided with the second junction section 62 described above. The branching junction 70 causes the outgoing path side root path 36*a* to branch into the outgoing path side second branch path 54 which is connected to the second connection port 72 and the downstream side root path 36*d* which is connected to the third connection port 73 via the outgoing path filter 30 between the heating section 31 and the filter element 58. The ink supply section 5A which is configured in this manner has the same operational advantages as the ink supply section 5 described above.

Note that, the branching junction 70 is an example of "a branching section".

Figure 5:
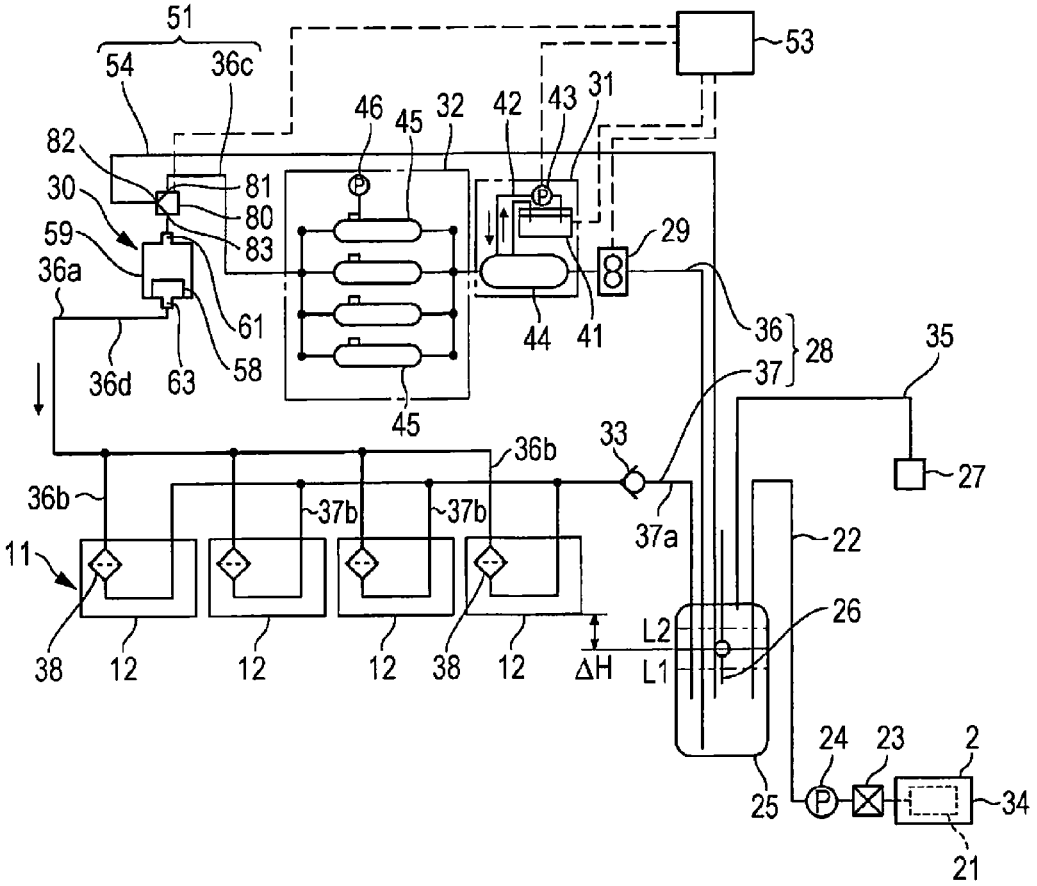
FIG. 5 is a piping flow diagram illustrating an ink supply section according to another modification example.

Description will be given of an ink supply section 5B according to another modification example with reference to FIG. 5. Although the ink supply section 5B is configured in substantially the same manner as the ink supply section 5A described above, the configuration differs in that a three-way valve 80 with a magnetic operation system is provided instead of the branching junction 70. The three-way valve 80 is provided with a first port 81, a second port 82, and a third port 83. The second port 82 protrudes in a direction which is substantially perpendicular to the first port 81 and the third port 83. The third port 83 protrudes on the opposite side from the first port 81. The downstream end of the upstream side root path 36*c* is connected to the first port 81. The upstream end of the outgoing path side second branch path 54 is connected to the second port 82. The first junction section 61 of the outgoing path filter 30 is connected to the third port 83. The three-way valve 80 causes the outgoing path side root path 36*a* to branch into the outgoing path side second branch path 54 which is connected to the second port 82 and the downstream side root path 36*d* which is connected to the third port 83 via the outgoing path filter 30 between the heating section 31 and the filter element 58. The three-way valve 80 can enter a first state and a second state. In the first state, the first port 81 communicates with the third port 83 and the flowing of the UV ink from the upstream side root path 36*c* to the outgoing path side second branch path 54 is prevented, and in the second state, the first port 81 communicates with the second port 82 and the flowing of the UV ink from the upstream side root path 36*c* to the outgoing path side second branch path 54 is allowed. The three-way valve is controlled by the control section 53 so as to switch between the first state and the second state. The ink supply section 5B which is configured in this manner has the same operational advantages as the ink supply section 5 described above.

Note that, the three-way valve 80 is an example of "the branching section" including "the valve".

Figure 6:
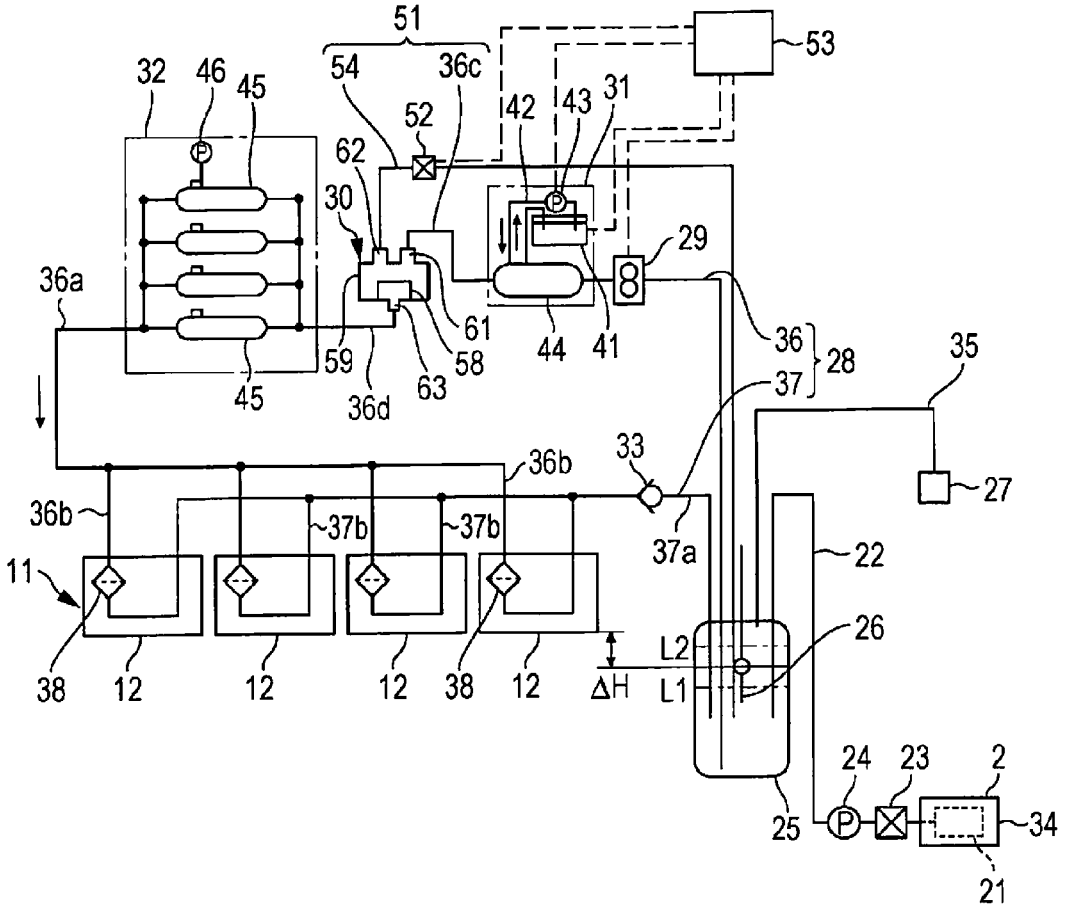
FIG. 6 is a piping flow diagram illustrating an ink supply section according to still another modification example.

Description will be given of an ink supply section 5C according to still another modification example with reference to FIG. 6. Although the ink supply section 5C is configured in substantially the same manner as the ink supply section 5 described above, the configuration differs in that the circulation outgoing path 36 branches between the heating section 31 and the degassing section 32. In other words, the filter housing 59 of the outgoing path filter 30 is provided between the heating section 31 and the degassing section 32. When the UV ink is caused to circulate within the second circulation flow path 51, a configuration of the ink supply section 5 in which the degassing section 32 is contained within the second circulation flow path 51 is preferable for the reason that the capacity of the UV ink which is heated to the predetermined temperature increases. Meanwhile, a configuration of the ink supply section 5C in which the degassing section 32 is not contained within the second circulation flow path 51 is preferable for the reason that a reduction in flow rate caused by pressure loss in the degassing section 32 is suppressed. Therefore, when the capacity of the degassing section 32 is great and the pressure loss in the degassing section 32 is small, the configuration of the ink supply section 5 is preferable, and when the capacity of the degassing section 32 is small and the pressure loss in the degassing section 32 is great, the configuration of the ink supply section 5C is preferable.

The printing apparatus 1 may be provided with an operation section which receives a switching operation for switching the second circulation flow path open-close valve 52 or the three-way valve 80 to the second state, and, when the operation section receives a switching operation, the control section 53 may switch the second circulation flow path open-close valve 52 or the three-way valve 80 to the second state. Accordingly, it is possible to cause the UV ink to circulate within the second circulation flow path 51 as necessary. In other words, the user may perform the switching operation on the operation section when the user wishes to heat the UV ink in a short time. It is possible to use various switches or the like such as an operation panel as the operation section, for example.

The control section 53 may detect that the UV ink within the second circulation flow path 51 has reached the predetermined temperature using a thermometer which is provided within the second circulation flow path 51 (containing the sub-tank 25).

The ink which is used in the printing apparatus 1 is not limited to the UV ink, and, for example, may be an aqueous ink, an oil-based ink, a solvent ink, or a volatile ink.

A configuration may be adopted in which only either one of the head filter 38 and the filter element 58 may be provided.

The entire disclosure of Japanese Patent Application No. 2015-063919, filed Mar. 26, 2015 is expressly incorporated by reference herein.

What is claimed is:

1. A printing apparatus including an ink ejecting head which ejects an ink and an ink reservoir section which reserves the ink, the printing apparatus comprising:

a first circulation flow path which includes a circulation outgoing path in which the ink which is supplied to the ink ejecting head from the ink reservoir section flows and a circulation return path in which the ink which returns to the ink reservoir section from the ink ejecting head flows;

a heating section which is provided in the circulation outgoing path and heats the ink which flows in the circulation outgoing path;

a degassing section which is provided in the circulation outgoing path and degases the ink which flows in the circulation outgoing path;

a branching section which branches the circulation outgoing path between the heating section and the ink ejecting head;

a branch path in which the ink which returns to the ink reservoir section from the branching section flows; and a control section capable of switching between a first state in which the ink which is heated in the heating section is returned to the ink reservoir section through the first circulation flow path and a second state in which the ink is returned to the ink reservoir section through the branch path, the degassing section being located between the ink reservoir section and the branching section, the control section setting a mode to the second state in at least a portion of a period from a start-up of the printing apparatus until the ink is ejected from the ink ejecting head to carry out image formation and setting the mode to the first state during the image formation.

2. The printing apparatus according to claim 1, wherein returning the ink which is heated by the heating section to the ink reservoir section through the branch path results in higher heating efficiency of the ink than returning the ink to the ink reservoir section through the first circulation flow path.

3. The printing apparatus according to claim 1, further comprising:

a valve capable of entering a first valve state in which the ink is prevented from flowing from an upstream side outgoing path which is closer to the upstream side than the branching section in the circulation outgoing path to the branch path, and a second valve state in which the ink is allowed to flow from the upstream side outgoing path to the branch path.

4. The printing apparatus according to claim 1, wherein the branching section includes a valve capable of entering a first valve state in which the ink is prevented from flowing from an upstream side outgoing path which is closer to the upstream side than the branching section in the circulation outgoing path to the branch path, and a second valve state in which the ink is allowed to flow from the upstream side outgoing path to the branch path.

5. The printing apparatus according to claim 3, wherein the control section switches a state of the valve to the second valve state during the start-up of the printing apparatus.

6. The printing apparatus according to claim 1, further comprising:

a filter section which is provided in at least one of the ink ejecting head and an area between the branching section and the ink ejecting head in the circulation outgoing path and filters the ink which flows in the first circulation flow path.

7. The printing apparatus according to claim 6, wherein a first filter section is provided between the branching section and the ink ejecting head in the circulation outgoing path as the filter section, and an upstream end of the branch path is provided above the first filter section.

8. The printing apparatus according to claim 1, wherein a flow path length obtained by adding a flow path length of an upstream side outgoing path which is closer to an upstream side than the branching section in the circulation outgoing path to a flow path length of the branch path is shorter than a flow path length of the first circulation flow path.

9. A printing apparatus including an ink ejecting head which ejects an ink and an ink reservoir section which reserves the ink, the printing apparatus comprising:

a first circulation flow path which includes a circulation outgoing path in which the ink which is supplied to the ink ejecting head from the ink reservoir section flows and a circulation return path in which the ink which returns to the ink reservoir section from the ink ejecting head flows;

a heating section which is provided in the circulation outgoing path and heats the ink which flows in the circulation outgoing path;

a branching section which branches the circulation outgoing path between the heating section and the ink ejecting head;

a branch path in which the ink which returns to the ink reservoir section from the branching section flows;

an operation section which receives an operation of switching by a user, between a first state in which the ink which is heated in the heating section is returned to the ink reservoir section through the first circulation flow path and a second state in which the ink is returned to the ink reservoir section through the branch path; and a control section which switches between the first state and the second state when the operation section receives the switching operation.

10. An ink heating method for a printing apparatus including an ink ejecting head which ejects an ink, an ink reservoir section which reserves the ink, a first circulation flow path which includes a circulation outgoing path in which the ink which is supplied to the ink ejecting head from the ink reservoir section flows and a circulation return path in which the ink which returns to the ink reservoir section from the ink ejecting head flows, a heating section which is provided in the circulation outgoing path and heats the ink which flows in the circulation outgoing path, a degassing section which is provided in the circulation outgoing path and degases the ink which flows in the circulation outgoing path;

a branching section which branches the circulation outgoing path between the heating section and the ink ejecting head, and a branch path in which the ink which returns to the ink reservoir section from the branching section flows, the degassing section being located between the ink reservoir section and the branching section, the method comprising:

returning the ink which is heated in the heating section to the ink reservoir section through the branch path in at least a portion of a period from a start-up of the printing apparatus until the ink is ejected from the ink ejecting head to carry out image formation; and returning the ink which is heated by the heating section to the ink reservoir section through the first circulation flow path during the image formation.

* * * * *